United States Patent [19]

Kojima et al.

[11] 4,193,825

[45] Mar. 18, 1980

[54] METHOD OF CARBON NITRIDING A METAL WORKPIECE

[75] Inventors: Rinzo Kojima; Kazuhiro Shibata, both of Inuyama; Sachio Nagata, Osaka, all of Japan

[73] Assignees: Kayaba Industry Co., Ltd.; Nihon Denshi Kogyo Kabushiki Kaisha, both of Japan

[21] Appl. No.: 405

[22] Filed: Jan. 2, 1979

Related U.S. Application Data

[63] Continuation of Ser. No. 810,833, Jun. 28, 1977, abandoned.

[51] Int. Cl.[2] ..... C21D 1/38

[52] U.S. Cl. ..... 148/16.6; 148/16.5

[58] Field of Search ..... 148/16.5, 16.6, 31.5; 252/372, 374, 376; 204/164

[56] References Cited

U.S. PATENT DOCUMENTS

| | | | |
|---|---|---|---|
| 3,035,205 | 5/1962 | Berghaus et al. | 204/164 |
| 3,190,772 | 6/1965 | Berghaus et al. | 148/16.6 |
| 3,730,863 | 5/1973 | Keller | 148/16.6 |
| 4,049,472 | 9/1977 | Arndt | 148/16.6 |

OTHER PUBLICATIONS

Metals Handbook, 8th ed., vol. 2, pp. 424–474.

"Low Temperature Gas Carbonitriding Method," Tugio Yonemura; Deuki Seiko, vol. 46, No. 4, 1975, Nov., pp. 227–232.

"Analysis and Conditions of Treatment of Compound Layers," Takao Takarei; Kinzohu Zairyo, vol. 17, No. 5, pp. 133–139.

*Primary Examiner*—L. DeWayne Rutledge
*Assistant Examiner*—John P. Sheehan
*Attorney, Agent, or Firm*—Townsend and Townsend

[57] ABSTRACT

In an ion nitriding method, a mixture of CO or $CO_2$ and nitrogen is compressed and then admitted into an evacuated discharge furnace. The furnace is heated to 400° C. to 600° C. for two hours for carbonitriding a workpiece. Depending upon the type of the workpiece, up to 30 volume percent of hydrogen is admixed with the mixture.

9 Claims, 5 Drawing Figures

METHOD OF CARBON NITRIDING A METAL WORKPIECE

This is a continuation of application Ser. No. 810,833, filed June 28, 1977 and now abandoned.

BACKGROUND OF THE INVENTION

This invention relates to a process of treating metal surfaces.

Chromium plating is most widely used for imparting wear resistance and corrosion resistance to iron, steel and alloy steel.

In the method of chromium plating, hexavalent chromium and trivalent chromium contained in the electrolyte react with lead dissolved into the electrolyte from an electrode plate to form lead chromate. Such lead chromate and gas thereof are harmful to human bodies. Although nickel plating, copper plating and other plating methods are also used, use of electrolytes causes public hazard. These plating methods are described in many publications, for example, Metals Handbook, 8th edition, Vol. 2 pp 424–474, published by American Society for Metals.

As a method not accompanying the problem of public hazard, a gas carbonitriding method has been proposed as described in a paper of Tugio Yonemura of the title "Low Temperature Gas Carbonitriding Method", of Denki Seiko, Vol. 46, No. 4, 1975, Nov. pp 227–232. According to this method nitriding is effected in ammonia gas or atmosphere containing ammonia and carbonizing gas and at a temperature higher than 500° C. This method gives more excellent result than hard chromium plating method in weather test and wear resistance test.

Although this method is excellent, use of ammonia accompanies public hazard and the method is expensive.

An ion nitriding method has recently been developed in which the problem of public hazard is not severe and the cost is low.

The ion nitriding method has been well known in the art for a long time and comprises the steps of injecting a mixture consisting essentially of $N_2$ gas and $H_2$ gas into a vacuum furnace and applying a DC voltage of several hundreds volts across the furnace acting as the anode electrode and an article to be treated which acts as the cathode electrode thereby establishing glow discharge. As is shown in Takao Talcase's paper of the title "Analysis and Condition of Treatment of Compound Layers" in Kinzoku Zairyo, Vol. 17, No. 5, pp 133–139, such hydrocarbon gas as $CH_4$ is added to the mixture of $N_2$ and $H_2$ for effecting ion nitriding. Articles treated by this method show satisfactory wear resistant property but their corrosion resistant property is not sufficient. For this reason, we have made various experiments in which such carbonaceous gas as CO was incorporated into the mixture of $N_2$ and $H_2$. Although, the addition of CO gas has improved the corrosion resistant property good result was not always obtained for any article since respective gas components do not uniformly disperse throughout the furnace so that satisfactory carbonitriding does not occur at nonuniform portions of the mixture. It was also found that the composition of the gas mixture influences the result of treatment. Where the amount of CO gas is excessive it undergoes decomposition to produce carbon which adheres to the article to be treated and prevents nitrization. Consequently the depth of the nitride layer is not uniform.

SUMMARY OF THE INVENTION

Accordingly, it is an object of this invention to proivide an improved method of carbonitriding the surface of metals.

Another object of this invention is to provide an improved method of carbonitriding the surface of metals which can uniformly carbonitride the surface, can produce products having a hardness comparable with that of chromium plating but having superior wear and corrosion resistant properties than chromium plating.

According to this invention, there is provided a method of surface treating metal comprising the steps of compressing to a predetermined pressure a mixture of 1 to 30 volume % of carbonaceous gas and the remainder of nitrogen gas, supplying the mixture into a discharge furnace containing a workpiece and continuously evacuated to a pressure of 0.4 to 20 Torr, heating the discharge furnace to a temperature of 400° C. to 600° C. for a predetermined time and then cooling the treated workpiece.

Usually, it is advantageous to admit up to 30 volume % of hydrogen into the furnace together with pressurized mixture of carbonaceous gas and nitrogen, but in certain cases, for example in the case of pure iron, the amount of hydrogen can be reduced extremely.

BRIEF DESCRIPTION OF THE DRAWINGS

Further objects and advantages of this invention can be more fully understood from the following detailed description taken in conjunction with the accompanying drawings in which.

DESCRIPTION OF THE PREFERRED EMBODIMENT

Figure 1:
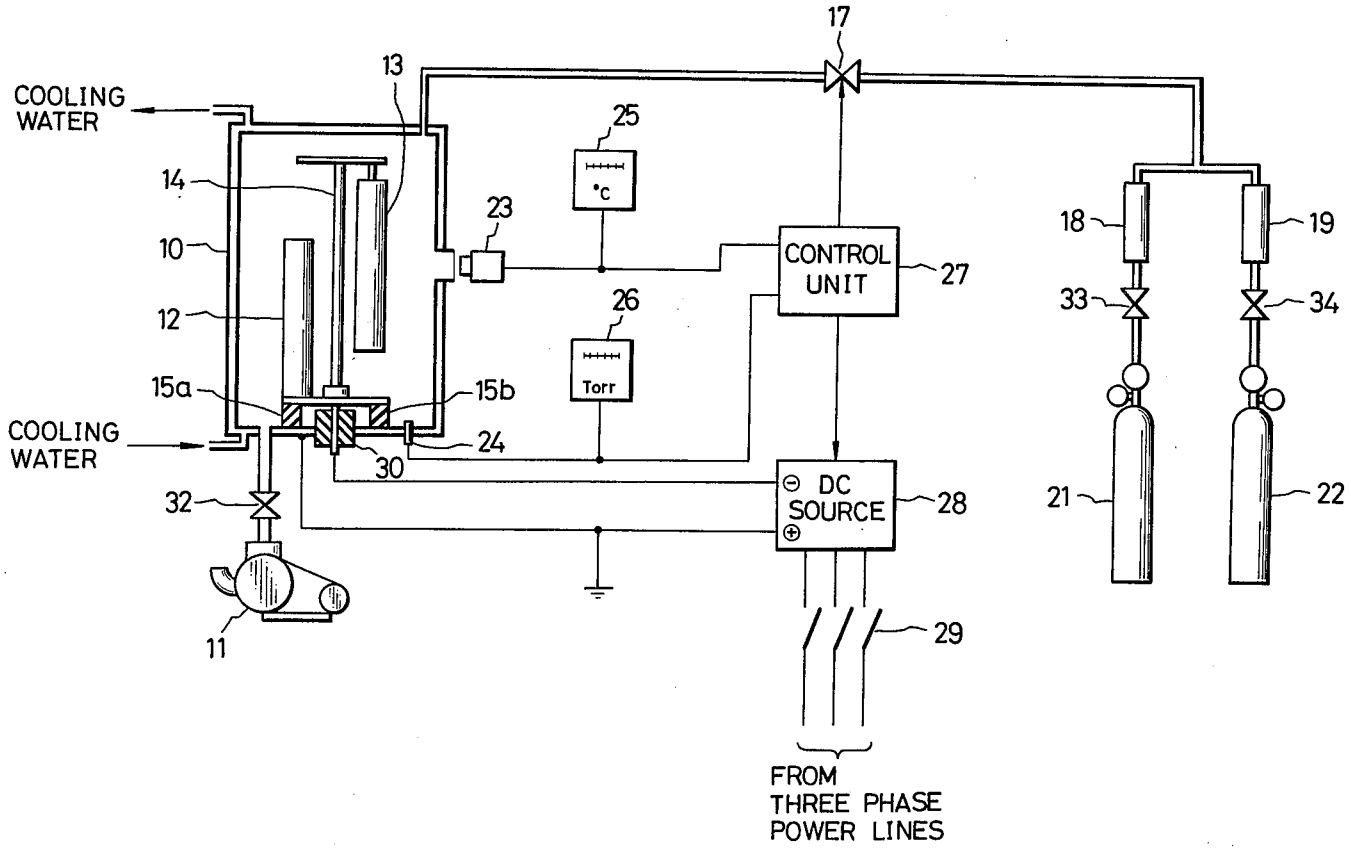
FIG. 1 is a diagrammatic representation of one example of the apparatus for carrying out the method of this invention.

With reference to FIG. 1, a vacuum furnace (electric discharge furnace) cooled by water circulating along the outer wall is evacuated by a vacuum pump 11, and workpieces 12 and 13 supported by a support 14 are insulated by an insulator **15*b*. The vacuum furnace 10 is connected to a bomb 21 filled with a gas mixture of CO gas and $N_2$ gas at a predetermined proportion and to a bomb 22 filled with $H_2$ gas, through a control valve 17 and gas flow meters 18 and 19. The furnace 10 is also provided with a temperature detector 23 and a gas pressure detector 24 which are connected to operate display meters 25 and 26 respectively and to a control unit 27. The control unit 27 is connected to a DC source 28 for controlling the control valve 17 and the power supply from the DC source 28 in response to the outputs of the detectors 23 and 24. The source 28 contains a rectifier and is connected to three phase power lines through a switch 29. The positive terminal of DC source 28 is connected to the ground and the furnace and the negative terminal is connected to the support 14 through a conductor extending through an insulator 30, 32, 33 and 34 are manually operated valves connected to the vacuum pump 11 and gas bombs 21 and 22** respectively.

Typical examples of the method of this invention will now be described.

EXAMPLE 1

A mixture of CO and $N_2$ was charged in bomb 21 under a pressure of about 150Kg/cm$^2$, and $H_2$ was charged in bomb 22. Then by opening valves 17, 32 and 34 a mixture of CO, $H_2$ and $N_2$ at a volume ratio of 14.5%, 10% and the remainder of $N_2$ respectively was supplied into the discharge furnace 10 containing the workpieces 12 and 13. The furnace 10 was evacuated by the pump 11 to a pressure of 10 Torr, and heated to 570° C. by a suitable heater, not shown. The carbonitriding treatment was continued for about 2 hours. The treated workpieces were taken out from the furnace, air cooled and polished.

Figure 2:
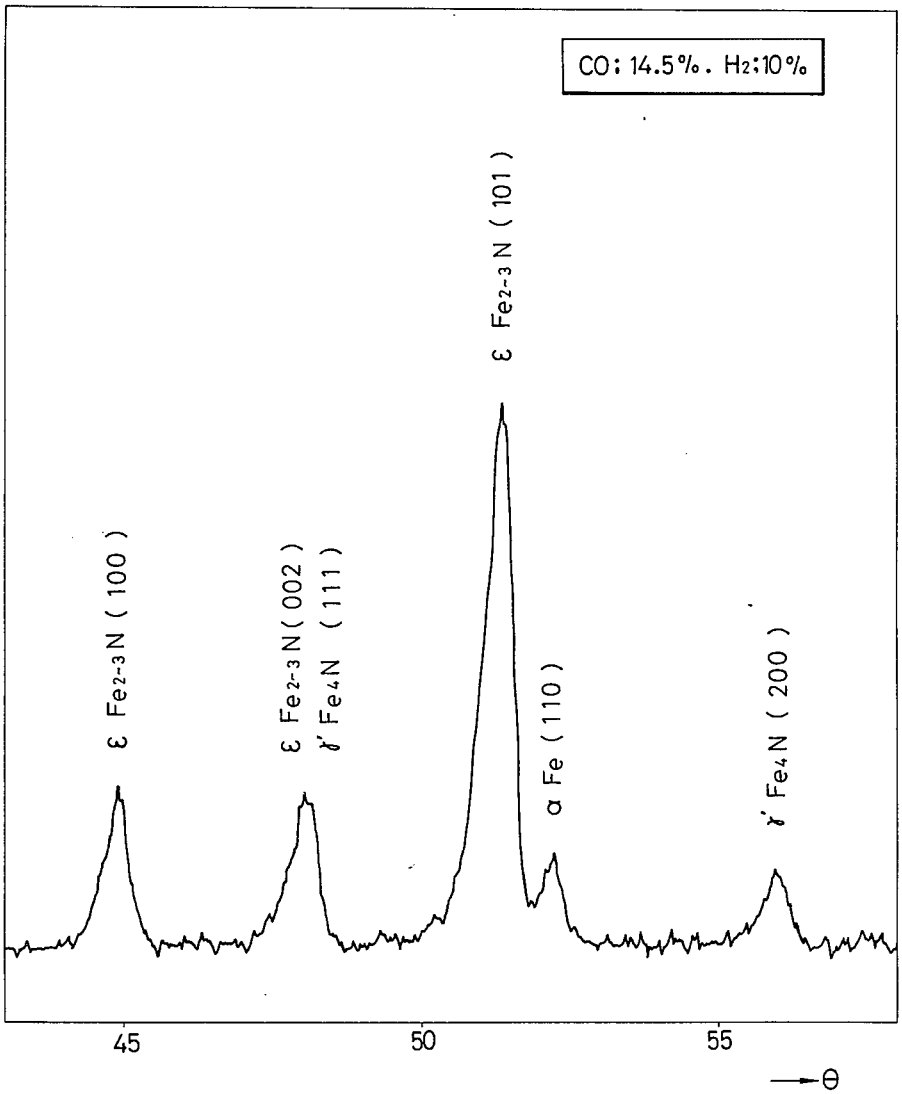
FIGS. 2 and 5 show X-ray diffraction patterns of the products produced by the method of this invention.
Figure 3:
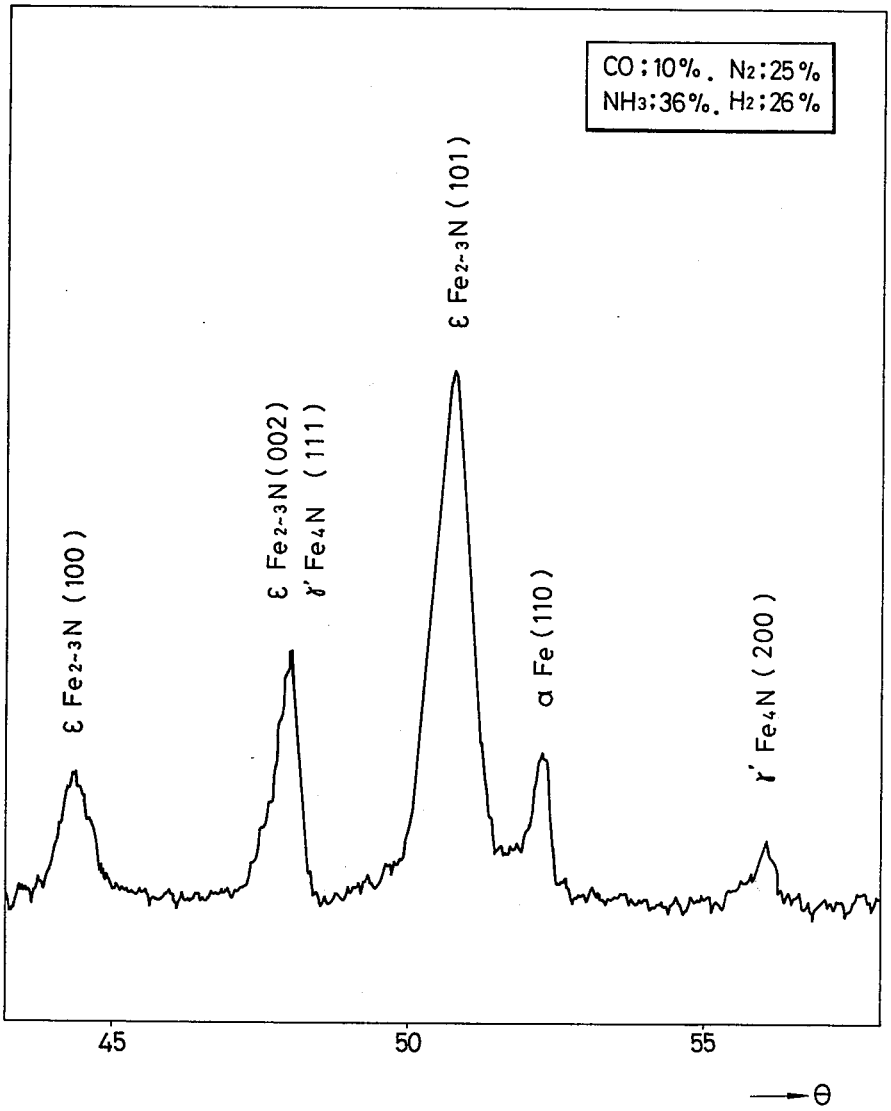
FIG. 3 shows a X-ray diffraction pattern of a product produced by a prior art gas carbonitriding method.
Figure 4:
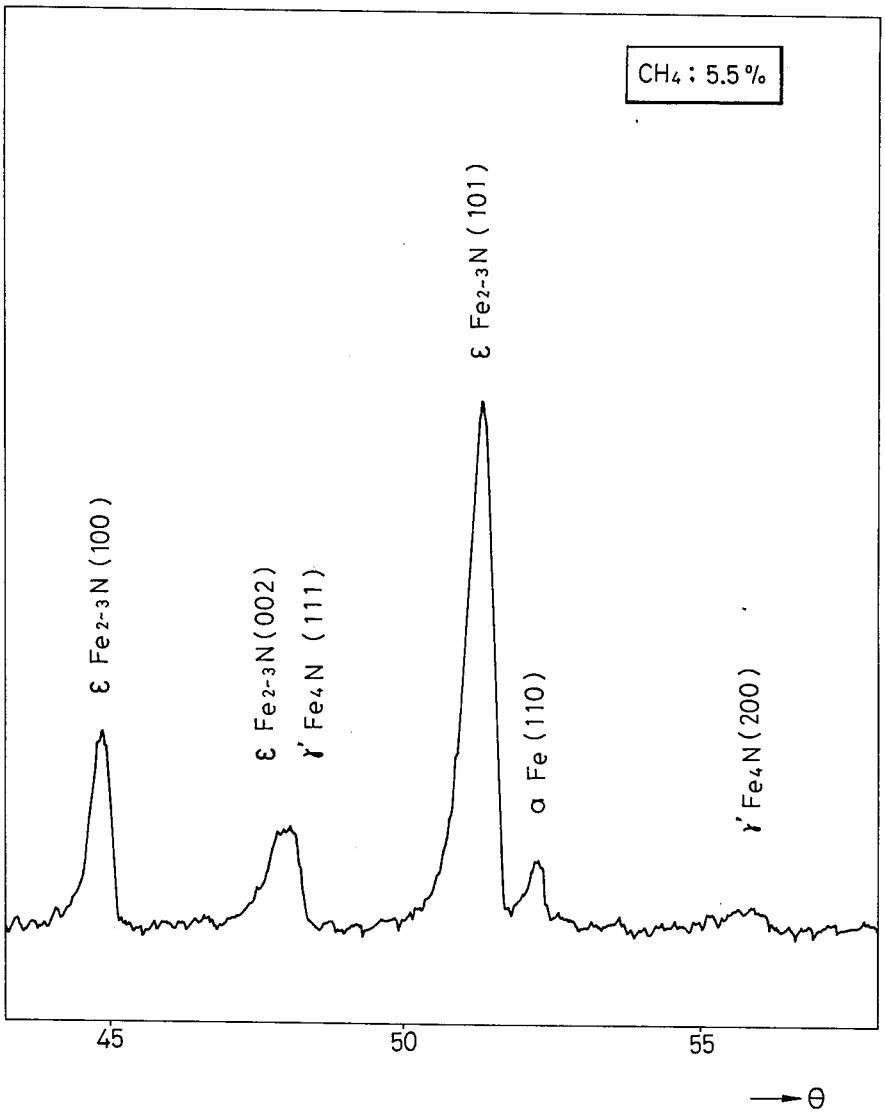
FIG. 4 shows a X-ray diffraction pattern of a product produced by a prior art ion nitriding method utilizing hydrocarbon gas.

FIG. 2 shows the X-ray diffraction pattern of the compound layer of the product treated as above described, and FIGS. 3 and 4 show the X-ray diffraction patterns of the products obtained by conventional gas carbonitriding method and ion nitriding method utilizing a hydrocarbon gas. By comparing FIGS. 2, 3 and 4 it will be noted that the diffraction patterns are substantially identical and have the same composition, that is a mixture of a major proportion of $\xi$ phase ($Fe_{2-3}N$) and a minor proportion of $\gamma'$ phase ($Fe_4N$). In this manner, the product of this invention can not be discriminated from the products of the prior art nitriding method but has excellent properties as will be pointed out hereinafter.

In each case, test piece was made of piston rod material S25C (carbon steel for machine structural use prescribed by JIS Standard JIS G4051) having a diameter of 10.12 mm prepared by cold drawing a steel rod having a diameter of 12mm and finished by grinding to have a diameter of $$10\text{mm}\ ^{-0.06}_{-0.07}$$

The test showed the following mechanical properties when tested with a test piece JIS 2 according to JIS B7702.

| | |
|---|---|
| tensile strength | 68 Kg/mm$^2$ |
| yielding point | 63 Kg/mm$^2$ |
| elongation | 11% |
| hardness | $H_RB$ 92 |

The compositions of the gases utilized in the gas carbonitriding method and the hydrocarbon ion nitriding methods are shown in FIGS. 3 and 4.

The mechanical properties, corrosion resistant property, thickness of the compound layer, hardness, hardness distribution and the surface coarseness of the products treated by the method of example 1 and by the prior art methods are as follows. Table 1 shows the comparison of mechanical properties of these products.

Table 1

| | JIS No. 2 Test Piece | | |
|---|---|---|---|
| | Example 1 | Gas Carbo-nitriding | Hard Chromium Plating |
| tensile strength Kg/mm$^2$ | 55 | 54 | 68 |
| yielding point Kg/mm$^2$ | 41 | 39 | 63 |
| elongation % | 25 | 23 | 11 |
| hardness $H_RB$ | 77 | 76 | 92 |

As can be noted from Table 1, the product of this invention has slightly inferior properties than the product of the hard chromium plating method but has better properties than the product of the gas carbonitriding method.

The corrosion resistant property was tested by the following brine spray test according to JIS Z2371 in which:

| | |
|---|---|
| sprayed liquid | 5 ± 1% NaCl |
| PH | 6.5 |
| temperature | 35 ± 2° C. |
| humidity | 98-100% |
| Atomizing air pressure | 0.7-1.8 Kg/cm$^2$ |
| Amount of spray | 0.5-3.0cc/hr of solution can be collected in a horizontal area of 80 cm$^2$ |
| time | 48 hours |

The result of tests made under the conditions described above is shown in Table 2.

Table 2

| | |
|---|---|
| Example 1 | Rating* No. 8-10 |
| Gas Carbonitriding | Rating* No. 8-9 |
| Hard Chromium Plating | Rating* No. 7-8 |

*Rating No. follows Cass Test defined by JIS D 0210

As this table shows, the product of this invention has excellent corrosion resistant property.

Table 3 shows the comparison of the thickness of the compound layer, surface hardness and hardness distribution.

Table 3

| | Compound Layer | | Hardness Distribution Distance from the Surface mm | | | | | | | | | | |
|---|---|---|---|---|---|---|---|---|---|---|---|---|---|
| | Thickness (μ) | Hardness | 0.05 | 0.1 | 0.2 | 0.3 | 0.4 | 0.6 | 0.8 | 1.0 | 1.5 | 2.0 | 3.0 |
| Example 1 | 13-15 | 700-730 | 285 | 289 | 266 | 233 | 202 | 168 | 151 | 146 | 151 | 143 | 147 |
| Gas Carbonitriding | 15 | 500-550 | 288 | 281 | 263 | 251 | 226 | 174 | 154 | 149 | 146 | 146 | 143 |
| Hard Chromium Plating | 14 | 830-850 | — | — | — | — | — | — | 205 | — | — | — | |

Remark: The hardness was measured by a micro Vickers hardness meter under a load of 100gs.

As can be clearly noted from Table 3, the hardness distributions and the depths of the diffused layers of the method of example 1 and the gas carbonitriding method are substantially the same.

Although the depths of the compound layers of the method of example 1 and the gas carbonitriding method are substantially the same, the hardness of the latter is from 500 to 550 whereas that of the former is from 700 to 730. In other words, the compound layer formed by the method of this invention has a hardness near that of the hard chromium plating.

The surface coarseness measured by Tarysurf surface coarseness meter and multiplied by 50,000 was 0.4 μm for the hard chromium plating but 0.24 μm for the product of this invention.

EXAMPLE 2

Workpieces were placed in the discharge furnace and a mixture of CO and $N_2$ at a volume ratio of 14.5% and 85.5% was admitted into the furnace 10 from bomb 21 containing the mixture at a pressure of 125 Kg/cm$^2$. The furnace 10 was evacuated to 10 Torr by the vacuum pump 11 and heated for 2 hours at a temperature of 570° C. Thereafter, the treated workpieces were cooled in air and the surfaces thereof were polished.

Figure 5:
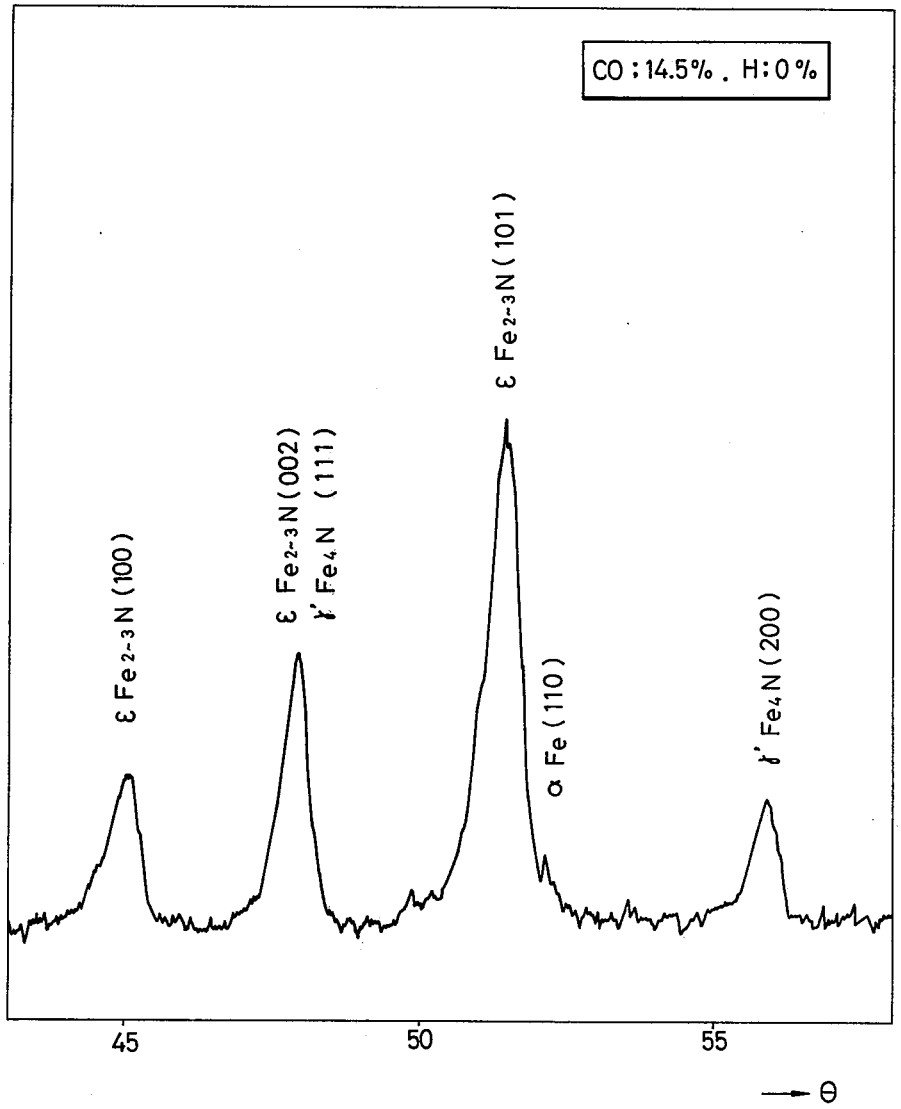

The product of this example showed a X-ray diffraction pattern as shown in FIG. 5 which is substantially the same as that shown in FIG. 2.

The compositions shown in examples 1 to 2 are only two examples of a number of compositions tested by the inventors. The result of our experiments shows that compositions consisting of 1 to 30% of carbonaceous gas (CO, $CO_2$), 30% of $H_2$ and remainder of $N_2$ give satisfactory result. It was also found that a gas pressure in the furnace of 0.4 to 20 Torr gives good result. For low carbon metals, for example pure iron and S15C (carbon steel for machine structural use prescribed by JIS G4051), the quantity of hydrogen may be reduced to a small quantity or zero.

Further, it should be noted that gases to be mixed in advance under the pressurized condition are not limited to two kinds like carbonaceous gas and nitrogen gas and that they may be admixed under a pressurized condition to be contained in a pressurized gas container like a bomb. It has been confirmed that the mixture prepared in the manner above gives also a good result. Especially, when the mixing ratio less than 10% is desired, a fine regulation of such mixing ratio is readily obtained by regulating the valves of different gas containers. Accordingly, pre-mixing like the above can present a stable gaseous mixture and a source thereof.

According to this invention, since at least carbonaceous gas and nitrogen are admixed and compressed and then admitted into the discharge furnace, the composition of the gas mixture is uniform throughout the furnace so that all portions of the workpiece are uniformly nitrided. The hardness of treated layer is comparable with that of chromium plating but the wear and corrosion resistant properties are more excellent than chromium plating.

In addition the method of this invention does not cause any public hazard different from gas nitriding method and the apparatus for carrying out the method is simplified.

What is claimed is:

1. A method of carbon nitriding the surface of a metal workpiece comprising the steps of forming a pressurized mixture of about 1 to about 30 volume % of carbonaceous gas and the remainder of nitrogen gas, supplying said mixture to an electric discharge furnace containing said workpiece, said furnace being continuously evacuated to an internal pressure in the range from about 0.4 to about 20 Torr, heating said workpiece to a temperature in the range from about 400° C. to about 600° C. for a predetermined time, and then cooling said treated workpiece.

2. The method of claim 1 wherein said carbonaceous gas is CO and said mixture is pressurized to a value of about 150 Kg/cm$^2$.

3. A method according to claim 1 wherein said predetermined time is about two hours.

4. A method according to claim 1 further including the step of supplying up to 30% by volume of hydrogen into said discharge furnace together with said mixture.

5. A method according to claim 1 further including the step of impressing a DC voltage of several hundred volts across the workpiece and the furnace for establishing glow discharge therebetween.

6. A method according to claim 1 wherein said mixture is pressurized to a value of about 125 Kg/cm$^2$ and contains substantially 14.5 volume % of CO and 85.5 volume % of $N_2$.

7. A method according to claim 1 wherein said predetermined pressure is in the range from about 125 Kg/cm$^2$ to about 150 Kg/cm$^2$.

8. A method of carbon nitriding the surface of a metal workpiece comprising the steps of forming a pressurized mixture of about 1 to about 30 volume % of carbonaceous gas, 0.1 to 30% volume of hydrogen and the remainder of nitrogen gas, supplying said mixture to an electric discharge furnace containing said workpiece, said furnace being continuously evacuated to a pressure of 0.4 to 20 Torr, heating said workpiece to a temperature in the range from about 400° C. to about 600° C. for a predetermined time, and then cooling said treated workpiece.

9. The method of claim 8 wherein said step of supplying includes the step of providing hydrogen gas to said mixture, the volume ratios of said CO, nitrogen and hydrogen gases being 14.5% CO, 10% $H_2$ and the remainder $N_2$, respectively.

* * * * *